US008469741B2

(12) United States Patent
Oster et al.

(10) Patent No.: US 8,469,741 B2
(45) Date of Patent: Jun. 25, 2013

(54) STRETCHABLE CONDUCTIVE CONNECTOR

(75) Inventors: Craig D. Oster, Oakdale, MN (US); Hatim M. Carim, West St. Paul, MN (US); Vinod P. Menon, Woodbury, MN (US); William Bedingham, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 135 days.

(21) Appl. No.: 12/990,057

(22) PCT Filed: Apr. 29, 2009

(86) PCT No.: PCT/US2009/042010

§ 371 (c)(1),
(2), (4) Date: Dec. 1, 2010

(87) PCT Pub. No.: WO2009/134823

PCT Pub. Date: Nov. 5, 2009

(65) Prior Publication Data

US 2011/0065319 A1 Mar. 17, 2011

Related U.S. Application Data

(60) Provisional application No. 61/049,678, filed on May 1, 2008.

(51) Int. Cl.
*H01R 13/40* (2006.01)

(52) U.S. Cl.
USPC ..... 439/586; 174/69

(58) Field of Classification Search
USPC ..... 439/586, 516, 371; 174/69, 502
See application file for complete search history.

(56) References Cited

U.S. PATENT DOCUMENTS

| | | | | | |
|---|---|---|---|---|---|
| 3,004,229 | A | * | 10/1961 | Stearns | 333/238 |
| 3,299,375 | A | * | 1/1967 | Thompson | 333/243 |
| 3,538,484 | A | * | 11/1970 | Fassafiume | 439/357 |
| 3,805,769 | A | | 4/1974 | Sessions | |
| 3,823,253 | A | * | 7/1974 | Walters et al. | 174/69 |
| 3,845,757 | A | | 11/1974 | Weyer | |
| 4,199,209 | A | | 4/1980 | Cherian | |
| 4,330,165 | A | | 5/1982 | Sado | |

(Continued)

FOREIGN PATENT DOCUMENTS

| | | |
|---|---|---|
| EP | 0122085 | 6/1987 |
| EP | 0282307 | 9/1988 |

(Continued)

OTHER PUBLICATIONS

Brosteaux, "Design and Fabrication of Elastic Interconnections for Streatchable Electronic Circuits", IEEE Electron Device Letters, Jul. 2007, vol. 28, No. 7, pp. 552-554.

(Continued)

*Primary Examiner* — Hae Moon Hyeon
(74) *Attorney, Agent, or Firm* — Thomas M. Spielbauer; Kevin D. Weber

(57) ABSTRACT

A stretchable conductive connector. The conductive connector can include a viscoelastic support member having a variable length, and a conductor coupled to the support member. The conductor can include at least one bend to accommodate the variable length of the viscoelastic support member.

13 Claims, 2 Drawing Sheets

U.S. PATENT DOCUMENTS

| | | | | |
|---|---|---|---|---|
| 4,402,562 | A | 9/1983 | Sado | |
| 4,520,562 | A | 6/1985 | Sado | |
| 4,524,087 | A | 6/1985 | Engel | |
| 4,527,087 | A | 7/1985 | Taya | |
| 4,539,996 | A | 9/1985 | Engel | |
| 4,554,924 | A | 11/1985 | Engel | |
| 4,640,289 | A | 2/1987 | Craighead | |
| 4,694,835 | A | 9/1987 | Strand | |
| 4,715,382 | A | 12/1987 | Strand | |
| 4,771,783 | A | 9/1988 | Roberts | |
| 4,846,185 | A | 7/1989 | Carim | |
| 4,848,353 | A | 7/1989 | Engel | |
| 5,012,810 | A | 5/1991 | Strand | |
| 5,133,356 | A | 7/1992 | Bryan | |
| 5,215,087 | A | 6/1993 | Anderson | |
| 5,226,225 | A | 7/1993 | Bryan | |
| 5,296,079 | A | 3/1994 | Romo | |
| 5,338,490 | A | 8/1994 | Dietz | |
| 5,385,679 | A | 1/1995 | Uy | |
| 5,427,535 | A | 6/1995 | Sinclair | |
| 5,516,581 | A | 5/1996 | Kreckel | |
| 5,660,178 | A | 8/1997 | Kantner | |
| 5,672,402 | A | 9/1997 | Kreckel | |
| 5,779,632 | A | 7/1998 | Dietz | |
| 5,816,848 | A * | 10/1998 | Zimmerman | 439/502 |
| 5,989,708 | A | 11/1999 | Kreckel | |
| D425,203 | S | 5/2000 | Sheehan | |
| 6,106,305 | A | 8/2000 | Kozel | |
| 6,168,442 | B1 | 1/2001 | Naoi | |
| D443,063 | S | 5/2001 | Pisani | |
| 6,231,962 | B1 | 5/2001 | Bries | |
| 6,235,990 | B1 * | 5/2001 | Morris et al. | 174/69 |
| D445,507 | S | 7/2001 | Pisani | |
| 6,286,208 | B1 | 9/2001 | Shih | |
| 6,289,238 | B1 | 9/2001 | Besson | |
| 6,312,393 | B1 | 11/2001 | Abreu | |
| 6,327,507 | B1 | 12/2001 | Buchan | |
| 6,385,473 | B1 | 5/2002 | Haines | |
| 6,403,206 | B1 | 6/2002 | Bries | |
| 6,447,308 | B1 | 9/2002 | McCarthy | |
| 6,494,829 | B1 | 12/2002 | New, Jr. | |
| 6,527,900 | B1 | 3/2003 | Kreckel | |
| 6,572,945 | B2 | 6/2003 | Bries | |
| 6,577,893 | B1 | 6/2003 | Besson | |
| 6,611,705 | B2 | 8/2003 | Hopman | |
| 6,743,982 | B2 * | 6/2004 | Biegelsen et al. | 174/69 |
| 6,830,549 | B2 | 12/2004 | Bui | |
| D501,558 | S | 2/2005 | Chastain | |
| D505,206 | S | 5/2005 | Chastain | |
| 7,136,691 | B2 | 11/2006 | Menon | |
| 7,197,357 | B2 | 3/2007 | Istvan | |
| 7,215,991 | B2 | 5/2007 | Besson | |
| 7,362,087 | B2 | 4/2008 | Kimura | |
| 7,491,892 | B2 * | 2/2009 | Wagner et al. | 174/254 |
| 8,207,473 | B2 * | 6/2012 | Axisa et al. | 219/121.72 |
| 2001/0019764 | A1 | 9/2001 | Bries | |
| 2003/0122021 | A1 | 7/2003 | McConnell | |
| 2007/0279217 | A1 | 12/2007 | Venkatraman | |
| 2007/0299325 | A1 | 12/2007 | Farrell | |
| 2008/0058614 | A1 | 3/2008 | Banet | |
| 2008/0097908 | A1 | 4/2008 | Dicks | |
| 2008/0097909 | A1 | 4/2008 | Dicks | |
| 2008/0097910 | A1 | 4/2008 | Dicks | |
| 2008/0097911 | A1 | 4/2008 | Dicks | |
| 2008/0097912 | A1 | 4/2008 | Dicks | |
| 2008/0097913 | A1 | 4/2008 | Dicks | |
| 2008/0097914 | A1 | 4/2008 | Dicks | |
| 2008/0097917 | A1 | 4/2008 | Dicks | |
| 2008/0173463 | A1 * | 7/2008 | Yamada et al. | 174/69 |
| 2010/0012345 | A1 * | 1/2010 | Kumar et al. | 174/69 |
| 2011/0308835 | A1 * | 12/2011 | Piekny | 174/69 |

FOREIGN PATENT DOCUMENTS

| | | |
|---|---|---|
| EP | 0875222 | 11/1998 |
| GB | 2058652 | 4/1981 |
| WO | WO 02-47737 | 6/2002 |
| WO | WO 2009-134826 | 11/2009 |

OTHER PUBLICATIONS

"Emissivity control Coatings", NanoSonic, Inc. Blackburg, Virginia, USA [Online],(date unknown but believed to be prior to the date of the filing of the present application), [retrived from internet on Apr. 15, 2008], URL <http://www.nanosonic.com/>, pp. 1-2.

Ruksakulpiwat, "Comparative study of structure and property of ziegler-natta and metallocene based linear low density polyethylene in injection moldings"School of Polymer Engineering Tech.Papers, 2001, 582-586.

"Stretchable and Elastic Electronics and Sensor Circuits @ TFCG Microsystems Lab", Ghent University,Belgium [Online],[updated on the internet on Nov. 7, 2007], [retrived from internet on Apr. 15, 2008], URL <http://tfcg.elis.ugent.be/projects/stretchable.html>, pp. 1-7.

"Why the LifeSync® System?", LifeSync Corporation [Online], [Updated on the internet on Feb. 1, 2008], [retrived from internet on Apr. 15, 2008], URL <http://www.lifesynccorp.com/healthcareproviders/why-lifesync.html>, pp. 1-10.

International Search Report for PCT/US2009/042013, mailed Jun. 24, 2009, 3 pages.

Written Opinion for PCT/US2009/042013, mailed Jun. 24, 2009, 8 pages.

International Search Report for PCT/US2009/042010, mailed Jan. 4, 2010, 6 pages.

Written Opinion for PCT/US2009/042010, mailed Jun. 4, 2010, 9 pages.

* cited by examiner

STRETCHABLE CONDUCTIVE CONNECTOR

CROSS REFERENCE TO RELATED APPLICATIONS

This application is a national stage filing under 35 U.S.C. 371 of PCT/US2009/042010, filed Apr. 29, 2009, which claims priority to provisional Application No. 61/049678, filed May 1, 2008, the disclosures of which are incorporated by reference in their entirety herein.

BACKGROUND

A variety of existing fixed-length conductive connectors can provide communication (e.g., electrical communication) between two points in a variety of different applications. Such connectors can be as simple as one wire. To accommodate a variety of distances between two points, multiple connectors can be coupled together to accommodate a longer distance, or a longer connector can be employed.

SUMMARY

Some embodiments of the present disclosure provide a conductive connector. The conductive connector can include a viscoelastic support member having a variable length, and a conductor coupled to the support member. The conductor can include at least one bend to accommodate the variable length of the viscoelastic support member.

Other features and aspects of the present disclosure will become apparent by consideration of the detailed description and accompanying drawings.

DETAILED DESCRIPTION

Figure 1:
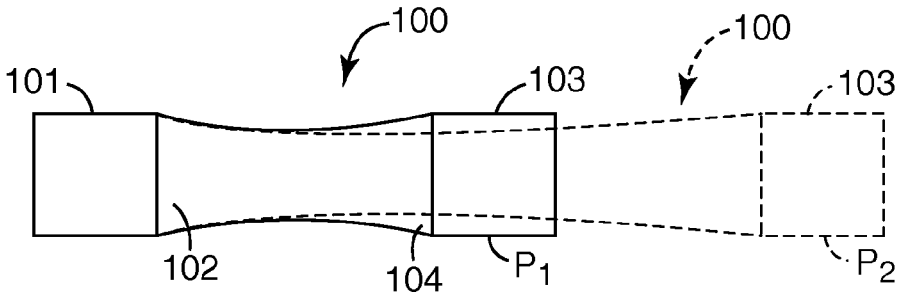
FIG. 1 is a top plan view of a conductive connector according to one embodiment of the present disclosure, the conductive connector shown connecting two devices.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "connected," and "coupled" and variations thereof are used broadly and encompass both direct and indirect connections, and couplings. Further, "connected" and "coupled" are not restricted to physical or mechanical connections or couplings. It is to be understood that other embodiments may be utilized, and structural or logical changes may be made without departing from the scope of the present disclosure. Furthermore, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

The present disclosure generally relates to a conductive connector that has a variable length to provide communication (e.g., electrical communication, electromagnetic (e.g., optical) communication, acoustic communication, thermal communication, mechanical communication, chemical communication, or a combination thereof) between two points that can be positioned various distances apart. That is, the variable-length conductive connector of the present disclosure can be sized to accommodate a first distance between two points, and the length of the connector can be increased or decreased to accommodate a variety of other distances between two points that are desired to be conductively coupled. As a result, a "one-size-fits-all" connector can be manufactured for a variety of applications requiring conductive connection, which can minimize manufacturing costs, reduce manufacturing waste, and provide a facile conductive coupling method. The conductive connector can be used in a variety of applications to transmit or conduct a signal from one point to another. Such a signal can include, but is not limited to, at least one of an electromagnetic signal (e.g., an optical signal), an electrical signal, an acoustic signal, a mechanical signal, a thermal signal, a chemical signal, and combinations thereof. One exemplary use of the stretchable conductive connector of the present disclosure is described in co-pending, commonly assigned, U.S. Patent Application Ser. No. 61/049,671, entitled "Biomedical Sensor System," (Oster et al.) and PCT Patent Application No. PCT/US2009/042013, entitled "Biomedical Sensor System" (Oster et al.), the disclosures of which are incorporated herein by reference.

Figure 2:
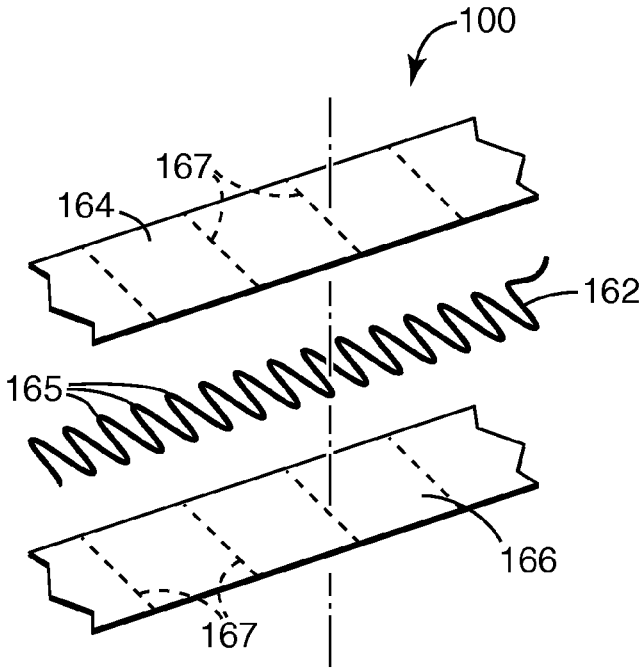
FIG. 2 is an exploded perspective view of the conductive connector of FIG. 1.

FIGS. 1 and 2 illustrate a stretchable conductive connector 100 having a variable length, according to one embodiment of the present disclosure. As shown in FIG. 1, the connector 100 is size-configurable. In some embodiments, the connector 100 is sized (e.g., in an initial, unstretched, state) to accommodate a relatively small distance but is configurable to accommodate a larger distance. A first device 101 can be coupled to a first end 102 of the connector 100, and a second device 103 can be coupled to a second end 104 of the connector 100, such that the first and second devices 101 and 103 are positioned in communication (e.g., electrical communication) via the connector 100. In the embodiment illustrated in FIGS. 1 and 2, the connector 100 is at least partially formed of a viscoelastic material, such that by applying a force to either end 102 or 104 of the connector 100, the connector 100 can be elongated. Elongation of the connector 100 can cause the first and second devices 101 and 103 to move a greater distance apart, or can allow the connector 100 to bridge a larger gap between the first and second devices 101 and 103. A variety of viscoelastic materials can be employed, ranging from viscoelastic materials that are largely elastic and exhibit substantial elastic deformations to viscoelastic materials that exhibit substantial plastic deformations and minimal elastic deformations.

The term "device" is used generally to refer to a device that is desired to be in communication with another device or point of contact. The term device is used generically and be thought to represent a variety of devices in a variety of applications. By way of example only, in some embodiments, one or more devices can include a mechanical actuator that upon certain conditions (e.g., a physiological state, if the devices employed are medical devices, such as patient monitoring devices) triggers a mechanical or mechano-electrical response that is communicated to another device at the other end of the connector 100. In such embodiments, for example, the connector 100 can include a first conductor to carry an electrical signal and a second conductor that moves to actuate and/or send a mechanical signal to the other device. The first and second devices 101 and 103 are shown by way of example only to represent that the connector 100 is providing communication between two points. However, it should be understood that the connector 100 can be used to join one or more points of contact (e.g., electrical contact) that may be required in a variety of systems and devices, and need not only be used to join two separate devices.

The variable-length feature of the connector 100 is illustrated in FIG. 1. Due at least in part to the viscoelastic material of the connector 100, for example, the second device 103 can be moved from a first position $P_1$ nearer the first device 101 to a second position $P_2$ farther from the first device 101, and the second device 103 can remain at the second position $P_2$ for a desired period of time. Alternatively, the connector 100 can be elongated (or shortened) to accommodate the gap between the first and second devices 101 and 103. If the second position $P_2$ is not sufficient for accurate placement of the second device 103, force can again be applied to the one or both of the first and second ends 102 and 104 of the connector 100, and the second device 103 can be moved farther away from the first device 101 to a third position (not shown), and so on, until either the plastic properties of the connector 100 are exhausted or the first and second devices 101 and 103 have reached their desired locations. FIG. 1 illustrates the second device 103 being moved away from the first device 101, but it should be understood that the first device 101 can instead be moved away from the second device 103 by extending the connector 100, or the first and second devices 101 and 103 can be described as moving a farther distance apart from one another as the length of the connector 100 increases.

The connectors 100 shown in FIG. 1 is used to couple the first device 101 to the second device 103. However, in some embodiments, a third device (not shown) can be coupled an additional, farther distance along its length, and so on. Alternatively, in some embodiments, a series of connectors 100 can be employed to connect two or more devices in series and provide a variable-length between the successive devices.

In some embodiments, the length of the connector 100 can be decreased, for example, by stretching the connector 100 substantially along its width, such that by extending the width of the connector 100, the length of the connector 100 decreases, and the connector 100 is shortened.

As mentioned above, the connector 100 mechanically and conductively (e.g., electrically) couples the first device 101 to the second device 103. The connector 100 has a variable length, such that the length of the connector 100 can be changed to change the position of the first and second devices 101 and 103, to allow the connector 100 to accommodate a variety of distances between first and second devices 101 and 103, and/or to allow one or both of the first and second devices 101 and 103 to be positioned a variable distance apart and then connected with the connector 100.

By way of example only, the connector 100 is illustrated in FIG. 2 as comprising a wire as a conductor 162 (e.g., a wire of suitable ductility, such as a copper wire). The conductor 162 is illustrated as being positioned between a first support member 164 and a second support member 166 to provide a communication pathway (e.g., an electrical communication pathway). The conductor 162 can extend beyond the length of the support members 164, 166 for facile connection and communication, or communication can be provided by accessing the conductor 162 via one or more of the support members 164, 166 (e.g., by clamping through the support members 164, 166 to access the conductor 162).

The term "conductor" is used to generally refer to a signal conduction medium that can be used to provide communication from one point to another along the length of the connector 100. In addition, the term "conductor" can refer to coated or insulated conductors, or exposed, uncoated conductors. Finally, the term "conductor" is not meant to indicate only generally cylindrical structures, but rather can take on any shape or configuration necessary to provide communication in the connector 100. Exemplary electrical conductors can be formed of a variety of materials, including, but not limited to, metal, carbon, graphite, or combinations thereof. In some embodiments, conductive flakes (e.g., formed of metal, carbon, graphite, other suitable conductive materials, or combinations thereof) can function as the conductor 162 and can be provided in a matrix or carrier on one or more of the support members 164, 166, or can be embedded directly into one or more of the support members 164, 166. In some embodiments employing an insulating coating over the conductor, the coating can be made from a relatively electrically conductive material that can be used as a shielding to minimize any interference from unwanted environmental signals.

By way of further example, in some embodiments employing optical signals, the term "conductor" can be used to generally refer to one or more optical fibers. In addition, in some embodiments, the term "conductor" can be used to generally refer to a conductor of another energy modality, such as near infrared light modulation. In some embodiments, the connector 100 can include a variety of the above-described energy modalities, signals, and/or conductors.

The support members 164, 166 can be formed of a variety of materials capable of changing in length (e.g., elongating) when a force is applied to it. Particular utility has been discovered when the support members 164, 166 are formed of a viscoelastic material, such that the connector 100 may exhibit at least some elastic properties but when sufficient force is applied and/or the connector 100 is elongated past a certain point, the connector 100 does not exhibit immediate elastic recovery and exhibits plastic deformation. Such viscoelastic properties can allow, for example, the first device 101 to be positioned at a desired location without the connector 100 causing the first device 101 to be pulled (e.g., by shortening/contracting of the connector 100). On the contrary, at least some plastic deformation can occur as force is applied to the connector 100 to elongate or shorten the connector 100, allowing the second device 103 to remain in a second position $P_2$ for a desired period of time. Such viscoelastic materials are embodied, for example, in 3M™ COMMAND™ adhesive articles, such as 3M™ COMMAND™ hooks, commercially available from 3M Company, St. Paul, Minn. 3M™ COMMAND™ backings are examples of multilayer laminates of individually viscoelastic materials that exhibit necking at low yield stresses and have high elongations at break. Such backings can be useful as one or more of the support members 164, 166. The support members 164, 166 can be coupled together using, for example, any of the pressure sensitive adhesives described herein. One example of a multilayer laminate that can be employed in one or more of the support members 164, 166 includes a linear low density polyethylene (LLDPE)/polyethylene (PE) foam/LLDPE trilayer laminate.

In some embodiments, the first device 101 and/or the second device 103 may be coupled to a substrate, for example, via an adhesive. In some embodiments, the adhesive that couples the device 101 or 103 to a substrate can include a stretch release adhesive, such as those described in U.S. Pat. Nos. 6,527,900, 5,516,581, 5,672,402, and 5,989,708 (Kreckel et al.); U.S. Patent. Application Publication No. 2001/0019764 (Bries, et al.); and U.S. Pat. Nos. 6,231,962 and 6,403,300 (Bries et al.), each of which is commonly owned by the Assignee of the present application, and is incorporated herein by reference. In such embodiments, the adhesive can be coupled (e.g., directly or indirectly) to at least a portion of the connector 100, such as one or more of the support members 164, 166, which in turn can function as the "backing" to the stretch release adhesive. As a result, the connector 100 (e.g., one or more of the support members 164, 166) can include one or more stretchable layers that can be stretched to a point that causes debonding of the adhesive.

In such embodiments, the connector 100 can be elongated or shortened for proper placement of each device 101 or 103 and when it is time to remove a device 101 or 103 from its respective substrate, the connector 100 can be stretched again until debonding of the adhesive occurs, and device 101 or 103 is removed from the substrate. In such embodiments, the adhesive can be designed such that the initial elongation of the connector 100 for placement of the device 101 or 103 is not sufficient to inhibit the bonding properties of the adhesive.

Suitable materials for any of the stretchable layers of the connector 100 can include any materials which are stretchable without rupture by at least 50 percent elongation at break and which have sufficient tensile strength so as not to rupture before debonding of the adhesive. Such stretchable materials may be either elastically deformable or plastically deformable, provided sufficient stretching is possible to cause adhesive debonding of both adhesive surfaces for stretch removal.

Suitable plastic backing materials are disclosed in the above listed U.S. patents to Kreckel et al. and Bries et al. Representative examples of materials suitable for either a polymeric foam or solid polymeric film layer in the connector 100 of the type utilizing a plastic backing include polyolefins, such as polyethylene, including high density polyethylene, low density polyethylene, linear low density polyethylene, and linear ultra low density polyethylene, polypropylene, and polybutylenes; vinyl copolymers, such as polyvinyl chlorides, both plasticized and unplasticized, and polyvinyl acetates; olefinic copolymers, such as ethylene/methacrylate copolymers, ethylene/vinyl acetate copolymers, acrylonitrile-butadiene-styrene copolymers, and ethylene/propylene copolymers; acrylic polymers and copolymers; polyurethanes; and combinations of the foregoing. Mixtures or blends of any plastic or plastic and elastomeric materials such as polypropylene/polyethylene, polyurethane/polyolefin, polyurethane/polycarbonate, polyurethane/polyester, can also be used.

Polymeric foam layers for use in the plastic backing of the connector 100 can include a density of about 2 to about 30 pounds per cubic foot (about 32 to about 481 kg/m$^3$), particularly in constructions where the foam is to be stretched to effect debonding of the adhesive. Particular utility has been found with polyolefin foams, including those available under the trade designations "VOLEXTRA" and "VOLARA," commercially available from Voltek, Division of Sekisui America Corporation, Lawrence, Mass.

Elastomeric materials suitable as materials for stretch release constructions of the connector 100 include styrene-butadiene copolymer, polychloroprene (neoprene), nitrile rubber, butyl rubber, polysulfide rubber, cis-i, 4-polyisoprene, ethylene-propylene terpolymers (EPDM rubber), silicone rubber, polyurethane rubber, polyisobutylene, natural rubber, acrylate rubber, thermoplastic rubbers such as styrene butadiene block copolymer and styrene-isoprene-styrene block copolymer and TPO rubber materials.

Solid polymeric film backings can include polyethylene and polypropylene films, such as linear low density and ultra low density polyethylene films, such as a polyethylene film available under the trade designation "MAXILENE 200" from Consolidated Thermoplastics Company, Schaumburg, Ill.

The connector 100 (e.g., one or more of the support members 164, 166) may vary in overall thickness so long as it possesses sufficient integrity to be processable and provides the desired performance with respect to stretching properties for debonding the adhesive from a substrate. The specific overall thickness selected for the connector 100 can depend upon the physical properties of the polymeric foam layer(s) and any solid polymeric film layer that make up the connector 100. Where only one polymeric film or foam layer of a multilayer connector 100 is intended to be stretched to effect debonding, that layer should exhibit sufficient physical properties and be of a sufficient thickness to achieve that objective.

A plastic polymeric film layer can be about 0.4 to 10 mils (0.01 mm to 0.25 mm) in thickness, and particularly, can be about 0.4 to 6 mils (0.01 mm to 0.15 mm) in thickness.

The above-listed connector materials are described as being useful in embodiments employing a stretch release adhesive in one or more devices to which the connector 100 is coupled. However, it should be understood that the connectors 100 can include any of the above-listed materials even in embodiments that do not employ a stretch release device adhesive. That is, the above-listed materials can provide the stretchable, variable-length properties to the connectors 100, even in embodiments that will not require the stretchable properties for removal of a device from a substrate.

If employed, the adhesive of the adhesive layer(s) of the device 101 or 103 can comprise any pressure-sensitive adhesive. In some embodiments, the adhesion properties generally range from about 4 N/dm to about 300 N/dm, in some embodiments, from about 25 N/dm to about 100 N/dm, at a peel angle of 180°, measured according to PSTC-1 and PSTC-3 and ASTM D 903-83 at a peel rate of 12.7 cm/min. Adhesives having higher peel adhesion levels usually require connectors 100 having a higher tensile strength.

Suitable pressure-sensitive adhesives include tackified rubber adhesives, such as natural rubber; olefins; silicones, such as silicone polyureas; synthetic rubber adhesives such as polyisoprene, polybutadiene, and styrene-isoprene-styrene, styrene-ethylene-butylene-styrene and styrene-butadiene-styrene block copolymers, and other synthetic elastomers; and tackified or untackified acrylic adhesives such as copolymers of isooctylacrylate and acrylic acid, which can be polymerized by radiation, solution, suspension, or emulsion techniques.

In some embodiments, the thickness of each adhesive layer can range from about 0.6 mils to about 40 mils (about 0.015 mm to about 1.0 mm), and in some embodiments, from about 1 mils to about 16 mils (about 0.025 mm to about 0.41 mm).

Adhesives for adhering one polymeric foam layer to either another polymeric foam layer or a solid polymeric film layer include those pressure-sensitive adhesive compositions described above. In some embodiments, the adhesive layer for adjoining one polymeric layer of the connector 100 (e.g., one support member 164 or 166) to another will be about 1 to 10 rails (about 0.025 to 0.25 mm) in thickness. Other methods of adhering the polymeric layers of the backing (i.e., the support members 164 and 166) to one another include such conventional methods as co-extrusion or heat welding.

The adhesive of the device 101 or 103, if employed, can be produced by any conventional method for preparing pressure-sensitive adhesive tapes. For example, the adhesive can either be directly coated onto a backing (e.g., a support member 164 or 166 of the connector 100), or it can be formed as a separate layer and then later laminated to the backing.

In some embodiments, the viscoelastic material employed in the connector 100 can allow percent elongations of at least 300%, and in some embodiments, at least 600%. For example, Table 1 lists the mechanical properties of metallocene catalyzed linear low density polyethylene (LLDPE) and Ziegler Natta catalyzed LLDPE at various processing conditions. Such linear low density polyethylenes would be suitable for use in one or more of the support members 164, 166 of the connector 100. The information contained in Table 1 was obtained from Ruksakulpiwat, "Comparative study and structure and properties of Ziegler-Natta and metallocene based linear low density polyethylene in injection moldings," as published in ANTEC-2001, Conference Proceedings, Volume-1, CRC Press, pp 582-586.

TABLE 1

Mechanical properties of metallocene catalyzed LLDPE (mLLDPE5100) and Ziegler Natta catalyzed LLDPE (ZNLLDPE2045) at various processing conditions

| Processing | Tensile Strength (MPa) | | Yield Strength (MPa) | | % Elongation at break | |
|---|---|---|---|---|---|---|
| condition | mLLDPE5100 | ZNLLDPE2045 | mLLDPE5100 | ZNLLDPE2045 | mLLDPE5100 | ZNLLDPE2045 |
| 1 | 14.49 | 13.29 | 13.28 | 12.33 | 655.2 | 726.2 |
| 2 | 1368 | 13.24 | 12.99 | 12.92 | 657.2 | 831.8 |
| 3 | 13.35 | 12.36 | 12.45 | 12.39 | 640.3 | 769.0 |
| 4 | 13.76 | 13.21 | 13.05 | 12.51 | 662.1 | 755.2 |
| 5 | 13.47 | 13.36 | 12.76 | 12.75 | 652.3 | 777.0 |
| 6 | 13.41 | 13.28 | 12.71 | 12.65 | 654.8 | 759.9 |
| 7 | 12.91 | 12.99 | 12.31 | 12.30 | 665.5 | 760.4 |

In addition, the support members 164, 166 can provide insulation to the conductor 162 in addition to, or in lieu of, an insulating coating or sheath that may encapsulate the conductor 162. As a result, particular utility can be found when support members 164, 166 are employed that not only have a variable length and have the ability to be elongated or shortened, but also which provide insulation to the means for providing communication along the connector 100.

Figure 3:
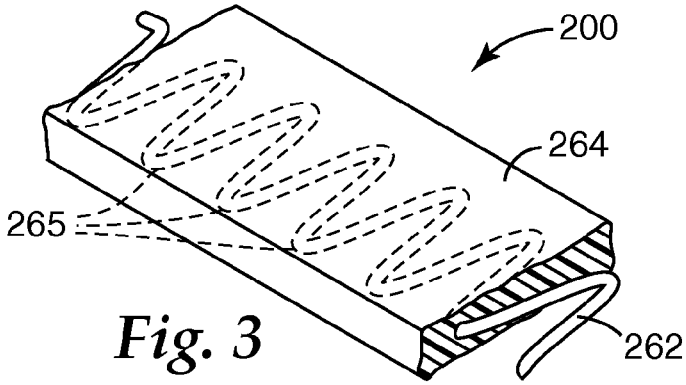
FIG. 3 is a perspective view of a conductive connector according to another embodiment of the present disclosure.

In the embodiment illustrated in FIG. 2, the conductor 162 is positioned between the first and second support members 164 and 166; however, it should be understood that the conductor 162 can instead be positioned within a single support member (e.g., embedded in a support member, as shown in FIG. 3 and described below). By way of example, the conductor 162 includes a plurality of bends 165 to allow the conductor 162 to maintain communication when the connector 100 is elongated or shortened. The number of bends 165 along the length of the connector 100 and the radius of curvature of each bend 165 can be determined to accommodate the desired extensibility or contractibility of the connector 100, and the material makeup of the connector 100 (e.g., the material makeup of the one or more support members 164, 166).

The conductor 162 can be adapted to couple to conductive elements of the first and second devices 101 and 103 in a variety of ways, including, but not limited to, clamps, snap-fit connectors (e.g., the distal end of the conductor 162 can be coupled to a snap-fit connector that will couple to a conductive element in the first or second device 101 or 103 via a snap-fit-type engagement), other suitable coupling means, and combinations thereof. In some embodiments, for example, the conductor 162 can include a braided conductor, and the end of the braided conductor can be stripped, with the individual conductors splayed out to provide multiple points of contact (e.g., a braided wire can be used to provide multiple points of electrical contact).

The conductor 162 is shown as a wire by way of example only. However, additionally or alternatively, in some embodiments, communication can be provided by a variety of other conductive materials. For example, electrical communication can be provided by a variety of electrically conductive materials, including, but not limited to, printed metal inks (e.g., conductive polymer thick film inks, commercially available from Ercon Inc., Wareham, Mass.); conductive thick film laminates (e.g., die cut silver, such as a die cut silver backing from 3M™ RED DOT™ electrodes, available from 3M™ Company, St. Paul, Minn.); conductive polymers (e.g., Ormecon polyaniline, commercially available from Ormecon GMBH, Ammersbek, Germany; PEDOT (polyethylendioxythiophene), commercially available from Bayer, Leverkusen, Germany); other suitable electrically conductive materials; or a combination thereof. Other suitable means for providing electrical conductivity along the length of the connector 106 to provide electrical communication between the first and second devices 101 and 103 can be understood by one of skill in the art and can be employed without departing from the spirit and scope of the present disclosure.

In some embodiments, the connector 100 can be disposable. Such disposable embodiments can be inexpensive and can be made from high-speed, facile, and inexpensive fabrication techniques. In addition, such disposable embodiments can be lightweight, can reduce wiring complexity, and can reduce overall costs. In some embodiments, disposable connectors 100 can be formed from any of the 3M™ COMMAND™ adhesive articles materials and constructions described above. For example, in some embodiments, disposable connectors 100 can be formed from a multilayer laminate comprising a first 3M™ COMMAND™ backing (e.g., with a corresponding 3M™ COMMAND™ adhesive), a conductive thick film laminate (such as the die cut silver described above), and a second 3M™ COMMAND™ backing. Such a construction would also provide radiotransparency. In such embodiments, the conductive thick film laminate can include the bends 165 shown in FIG. 2, and one or more of the support members 164, 166 can include one or more slits or weakened regions 167 to further accommodate varying the length of the connector 100. For example, in some embodiments, the one or more slits or weakened regions 167 can correspond with every bend 165, every other bend 165, every fourth bend 165, or the like.

One potential advantage of employing a wire as the conductor 162 over other means of providing electrical communication is that the wire will not exhibit a change in resistance as the length of the connector 100 is changed because the cross-sectional area of the wire will not change as the length of the connector 100 is changed, but rather the radius of curvature of the bends 165 of the wire will change, and the distance between adjacent segments of the wire will change.

In some embodiments employing a wire as the conductor 162, the wire can include a magnet wire (e.g., formed of one or more of copper, tin, carbon/graphite, other suitable wire materials, or a combination thereof) that is coated with a polymer (e.g., such as polyethylene, polyphenylene ether, other suitable polymers, or a combination thereof). Such embodiments of the conductor 162 can provide additional advantages, including, but not limited to, water resistance and electromagnetic shielding (e.g., in x-ray applications).

In addition, in some embodiments, the connector 100 can also be adapted to be coupled to a surface or substrate. For example, in some embodiments, the connector 100 can include an adhesive, such as an adhesive that may be employed in a device 101 or 103, such that when the connector 100 has been extended from a first unstretched state to a second stretched state, the connector 100 can be coupled to a substrate, for example, in a similar manner that the devices 101, 103 may be coupled to a substrate. In such embodiments, the at least a portion of the connector's adhesive can include a stretch release adhesive, such as those described above.

FIG. 3 illustrates a connector 200 according to another embodiment of the present disclosure, wherein like numerals represent like elements. The connector 200 shares many of the same elements and features described above with reference to the connector 100 of FIGS. 1-2. Reference is made to the description above accompanying FIGS. 1-2 for a more complete description of the features and elements (and alternatives to such features and elements) of the connector 200.

As shown in FIG. 3, in some embodiments, the connector 200 can include a conductor 262 comprising a plurality of bends 265 that is embedded in a support member 264, such that the conductor 262 provides communication while also having the capacity to accommodate an elongation or shortening of the connector 200/support member 264.

The conductor 262 can be embedded in the support member 264 in a variety of manners. For example, the conductor 262 can be molded, extruded, heat sealed, or otherwise formed with the support member 264.

Figure 4:
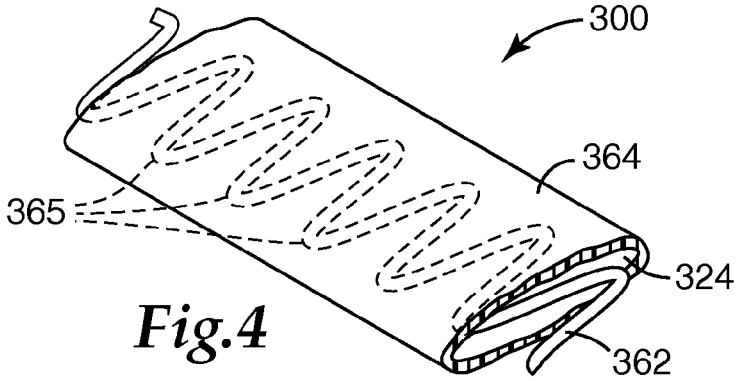
FIG. 4 is a perspective view of a conductive connector according to another embodiment of the present disclosure.

FIG. 4 illustrates a connector 300 according to another embodiment of the present disclosure, wherein like numerals represent like elements. The connector 300 shares many of the same elements and features described above with reference to the connector 100 of FIGS. 1-2. Reference is made to the description above accompanying FIGS. 1-2 for a more complete description of the features and elements (and alternatives to such features and elements) of the connector 300.

The connector 300 includes a support member 364 and a conductor 362 positioned within an interior 324 of the support member 364 to provide communication between one or more devices. The support member 364 includes substantially flattened tubular shape that defines the interior 324. The support member 364 includes a substantially flattened tubular shape by way of example only. Such a flattened structure can enhance conformability of the connector 300 to a surface, depending on the desired use of the connector 300; however, it should be understood that a variety of other suitable structures that define an interior can also be employed.

Similar to the conductor 162 described above, the conductor 362 includes a plurality of bends 365 to allow the conductor 362 to maintain communication when the connector 300 is elongated or shortened. The number of bends 365 along the length of the connector 300 and the radius of curvature of each bend 365 can be determined to accommodate the desired extensibility or contractibility of the connector 300, and the material makeup of the connector 300 (e.g., the material makeup of the support member 364).

Figure 5:
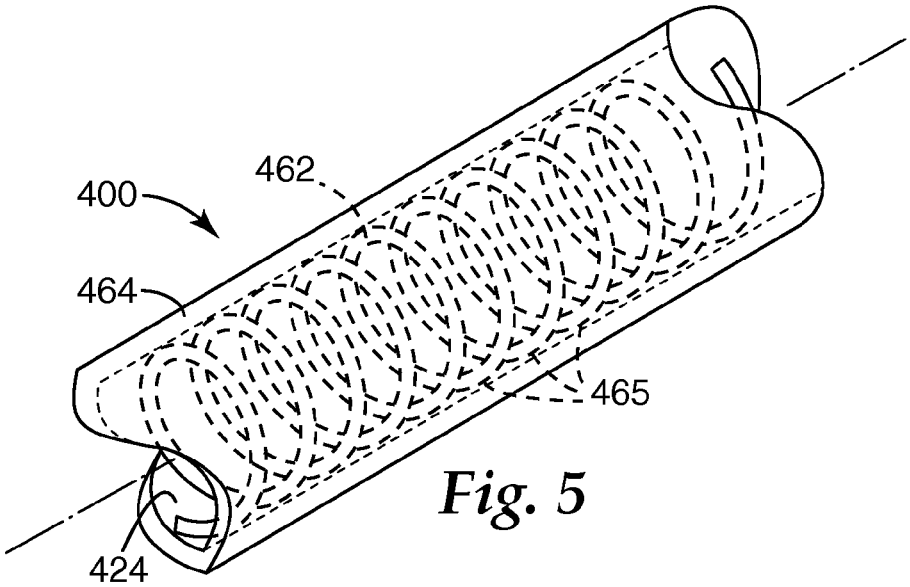
FIG. 5 is a perspective view of a conductive connector according to another embodiment of the present disclosure.

FIG. 5 illustrates a connector 400 according to another embodiment of the present disclosure, wherein like numerals represent like elements. The connector 400 shares many of the same elements and features described above with reference to the connector 100 of FIGS. 1-2. Reference is made to the description above accompanying FIGS. 1-2 for a more complete description of the features and elements (and alternatives to such features and elements) of the connector 400.

As shown in FIG. 5, the connector 400 includes a tubular-shaped support member 464 that defines an interior 424. A conductor 462 can be positioned within the interior 424 of the support member 464 to provide communication.

The conductor 462 includes a helical or spiral configuration comprising a plurality of loops or bends 465 to allow the conductor 462 to maintain communication when the connector 400 is elongated or shortened. The number of bends 465 along the length of the connector 400 and the distance between adjacent bends 465 can be determined to accommodate the desired extensibility or contractibility of the connector 400, and the material makeup of the connector 400 (e.g., the material makeup of the support member 464).

In some embodiments, the helical configuration of the conductor 462 can provide more conductor 462 per unit length of the connector 400 than other embodiments, which can accommodate a support member material having greater percent elongation, such that communication is maintained even at high levels of elongation. For example, in some embodiments, the helical conductor 462 can accommodate support members 464 having higher peak strains or percent elongations (e.g., at least about 500%, at least about 600%, etc.).

In some embodiments, the conductor 462 can be molded with the support member 464. For example, the support member 464 can be extruded over the prekinked or precoiled conductor 462 (e.g., following a similar method to extruding processes employed with respect to linear conductors, such as wires), or the conductor 462 can held in place by a pressure sensitive adhesive that is coated on the inner surface of the interior 424 of the support member 464.

In some embodiments, the connector 406 can include a core (e.g., formed of the same material as the support member 464), over which the conductor 462 can be wound. The support member 464 can then be extruded over the conductor 462 and core. In some embodiments, the support member 464 includes the core. By way of example only, a shielded stretchable connector 400 can be formed by co-extruding a three layer system of (1) a support member material (e.g., linear low density polyethylene (LLDPE)), (2) a carbon-filled support member material (e.g., carbon-filled LLDPE), and (3) a support member material (e.g., LLDPE) over the conductor 462.

While the connectors 100, 200, 300 and 400 are illustrated separately in FIGS. 2-5, respectively, it should be understood that one or more of the connectors 100, 200, 300 and 400 can be used in combination. For example, in some embodiments, one or more of the connectors 100, 200, 300 and 400 can be used in parallel in one system or device, or in series to provide communication from a first device to one or more additional devices.

The following working examples are intended to be illustrative of the present disclosure and not limiting.

EXAMPLES

Example 1

A Stretchable Electrical Connector having 500% Elongation

A sample of a 25-mil diameter solder wire (44 Rosin core, commercially available from Kester Inc., Glenview, Ill.) was cut to a length of 18 cm. A 15-cm section in the center, equidistant from both ends, was coiled over a 1-mm wire form and the pitch adjusted to obtain a coil having a length of 3 cm. The wire, serving as a conductor, was heat sealed in a linear low density polyethylene (LLDPE) film (Flexol ER276037), serving as a support member, so as to expose the two wire ends for electrical contact, and to form a connector. Two tabs were then affixed to the two ends of the heat-sealed film so as to partly cover the linear ends of the wire just outside of the coiled ends of the wire. The resistance across the wire was measured using a multimeter and registered at 1.3 ohms. The two tabs were then tightly grasped between the thumb and forefinger of each hand and the connector comprising the LLDPE laminate and the coiled wire was stretched to elongate the 3-cm section between the tabs to a length of 15 cm. During this process, the wire uncoiled and linearized. The resistance across the wire was measured again and was found to be unchanged at 1.3 ohms.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present disclosure. Various features and aspects of the invention are set forth in the following claims.

What is claimed is:

1. A conductive connector comprising:

a viscoelastic support member having a variable length; and a conductor coupled to the support member, the conductor including at least one bend to accommodate the variable length of the viscoelastic support member;

wherein the viscoelastic support member exhibits plastic deformation.

2. The conductive connector of claim 1, wherein the support member is a first support member and further comprising a second support member, and wherein the conductor is coupled between the first support member and the second support member.

3. The conductive connector of claim 1, wherein the conductor is embedded in the support member.

4. The conductive connector of claim 1, wherein the support member defines an interior, and wherein the conductor is positioned within the interior of the support member.

5. The conductive connector of claim 1, wherein the conductor has at least one of a spiral configuration and a conductive thick film laminate.

6. The conductive connector of claim 1, wherein at least a portion of the conductive connector is at least one of radiotransparent and disposable.

7. The conductive connector of claim 1, wherein the support member includes at least one slit or weakened region.

8. A method of providing a communication pathway between two points, the method comprising:

providing a variable-length connector having a first end and a second end, the connector adapted to provide a pathway between a first point and a second point for at least one of an electromagnetic signal, an electrical signal, an acoustic signal, a mechanical signal, a thermal signal, and a chemical signal;

changing the length of the connector to provide an appropriate distance between the first point and the second point;

coupling the first end of the connector to the first point; and coupling the second end of the connector to the second point;

wherein the variable-length connector comprises a viscoelastic support member and a conductor coupled to the support member, the conductor including at least one bend to accommodate the variable length of the viscoelastic support member, and wherein changing the length of the connector comprises plastically deforming the viscoelastic support member.

9. The method of claim 8, wherein changing the length of the connector occurs prior to at least one of coupling the first end of the connector to the first point and coupling the second end of the connector to the second point.

10. The method of claim 8, wherein changing the length of the connector includes changing the length of the connector a first time to provide a first distance between the first end of the connector and the second end of the connector, and further comprising changing the length of the connector a second time to provide a second distance between the first end of the connector and the second end of the connector.

11. The method of claim 8, wherein changing the length of the connector includes lengthening the variable-length connector, and wherein the second distance is greater than the first distance.

12. The method of claim 11, wherein changing the length of the connector a second time occurs after at least one of coupling the first end of the connector to the first point and coupling the second end of the connector to the second point.

13. The method of claim 8, wherein changing the length of the variable-length connector includes shortening the variable-length connector to decrease the distance between the first end of the connector and the second end of the connector.

* * * * *

UNITED STATES PATENT AND TRADEMARK OFFICE

CERTIFICATE OF CORRECTION

PATENT NO. : 8,469,741 B2
APPLICATION NO. : 12/990057
DATED : June 25, 2013
INVENTOR(S) : Craig Donald Oster et al.

It is certified that error appears in the above-identified patent and that said Letters Patent is hereby corrected as shown below:

On the Title Page

Page 1, Column 2 (Other Publications)
Line 2, delete "Streatchable" and insert --Stretchable--, therefor.

Page 2, Column 2 (Other Publications)
Line 1, delete "Blackburg" and insert --Blacksburg--, therefor.
Line 3, delete "[retrived" and insert --[retrieved--, therefor.
Line 11, delete "[retrived" and insert --[retrieved--, therefor.
Line 15, delete "[retrived" and insert --[retrieved--, therefor.

In the Specifications

Column 5
Line 4, delete "Patent." and insert --Patent--, therefor.

Column 7
Line 6 (approx.) (Table 1), delete "1368" and insert --13.68--, therefor.

Signed and Sealed this
Twenty-eighth Day of January, 2014

Michelle K. Lee

Michelle K. Lee
*Deputy Director of the United States Patent and Trademark Office*